US006631531B1

(12) United States Patent
Franzino

(10) Patent No.: US 6,631,531 B1
(45) Date of Patent: Oct. 14, 2003

(54) QUICK LOAD AIR GUN

(75) Inventor: Joseph J Franzino, Redding, CT (US)

(73) Assignee: Goodway Technologies Corporation, Stamford, CT (US)

( * ) Notice: Subject to any disclaimer, the term of this patent is extended or adjusted under 35 U.S.C. 154(b) by 450 days.

(21) Appl. No.: 09/715,827

(22) Filed: Nov. 16, 2000

(51) Int. Cl.[7] ..... B08B 9/04
(52) U.S. Cl. ..... 15/3.5; 15/104.062
(58) Field of Search ..... 15/3.5, 104.062

(56) References Cited

U.S. PATENT DOCUMENTS 4,435,872 A * 3/1984 Leikam ..... 15/104.062
4,974,277 A * 12/1990 Casella ..... 15/3.5
5,329,660 A * 7/1994 Fowler ..... 15/3.5
5,974,611 A * 11/1999 Casella ..... 15/3.5

* cited by examiner

*Primary Examiner*—Theresa T. Snider
(74) *Attorney, Agent, or Firm*—Patrick J. Walsh

(57) ABSTRACT

A quick load air gun for cleaning conduits by propelling a foam projectile through the conduit by means of a compressed air charge. The air gun includes a quick load port for inserting projectiles into the gun chamber, and a compressed air circuit including an air control valve operated by a trigger for admitting a compressed air charge into the chamber, and for venting the chamber to ambiance on release of the trigger.

12 Claims, 5 Drawing Sheets

QUICK LOAD AIR GUN

BACKGROUND OF THE INVENTION

The present invention relates to tube cleaning and particularly to propelling foam pellets by compressed air through hydraulic hose, tubes, piping, conduits and the like for cleaning interior surfaces.

Compressed air propelled foam pellets or projectiles are used for cleaning the interior surface of a variety of conduits including hydraulic and pneumatic lines wherein the foam projectile removes particulate matter, wipes the interior wall, and absorbs surface film. The projectile outer diameter is greater than conduit bore diameter for effective cleaning of the interior wall with the projectile being propelled by compressed air. The projectile acts as a seal against the interior wall such that the full force of the compressed air acts to move the projectile through a conduit. Foam projectiles are available in a range of diameters for use in cleaning conduits in a corresponding range of diameters.

Hand held pneumatic guns of the type described in U.S. Pat. No. 4,974,277 are used to position a projectile for entry into a conduit, and to propel the projectile through the conduit with compressed air. A pneumatic gun of this type includes interchangeable nozzles in different sizes to accommodate different size projectiles for application over a range of conduit diameters.

The pneumatic gun includes a pivoting breech ring for interchanging nozzles and for hand loading projectiles one-by-one into the nozzle. In a first position the breech ring pivots open for breech loading of a projectile into the gun nozzle. The breech ring is then closed manually. By positioning the gun muzzle adjacent a conduit opening and pulling the trigger, a compressed air charge propels the projectile through the conduit. When the projectile passes through the conduit, the compressed air charge is completely dissipated. This loading and firing sequence is repeated for each projectile loaded into the pneumatic gun.

The steps of opening and closing an pneumatic gun breech for each projectile adds to the complexity and time consumed for completing a conduit cleaning work schedule.

In the event a conduit is obstructed or blocked and the projectile travels into and not through a conduit, the compressed air charge is not dissipated and acts both to force the blocked projectile and to force the air gun away from the conduit opening. The potential for obstructed conduits presents a safety hazard for an air gun operator and creates a need for dissipation of compressed air charges in these circumstances.

SUMMARY OF THE INVENTION

The present invention provides a new and improved air gun for cleaning the interior wall of various kinds of conduits utilizing compressed air propelled projectiles.

In a preferred embodiment of the invention, a pneumatic air gun for conduit cleaning with foam projectiles comprises a hand grip with actuating trigger, projectile loading chamber with a quick load port, a nozzle, and a compressed air circuit including an air flow control valve for directing air in propelling a projectile and for dissipating an air charge in the event of a conduit obstruction.

In one aspect of the invention, a projectile loading chamber surmounts the gun's handgrip and includes a quick load port through which projectiles are loaded into a nozzle fitted to the front of the projectile chamber. A door or port closure member is spring biased to normally closed position over the port. For loading the gun, foam projectiles are pushed through the port closure into a nozzle with the closure then returning to closed position. The interior of the chamber, as well as the nozzle interior behind the projectile then receive a compressed air charge when the trigger is pulled. Compressed air propels the projectile through a conduit cleaning its interior wall. Another projectile is then loaded and fired in this way. The nozzles are interchangeable for a range of nozzle diameters and projectiles for cleaning conduits in a corresponding range of diameters.

In another aspect of the invention, compressed air flows from a source through the gun's handgrip and through a trigger actuated air flow control valve into the gun chamber. In the event pressurized air remains in the gun chamber after firing a projectile by reason of an obstructed conduit, the air pressure is dissipated through the air flow control valve when the operator releases the trigger. The built-up compressed air then is diverted harmlessly through an exhaust circuit opened as the trigger is released. Trigger release also stops compressed air flow into the gun chamber.

The present invention, then, provides a quick loading pneumatic gun for propelling tube cleaning projectiles by compressed air with a safety circuit for harmlessly dissipating any compressed air build-up in the event of an unexpected tube blockage.

A specific example is included in the following description for purposes of clarity, but various details can be changed within the scope of the present invention.

OBJECTS OF THE INVENTION

An object of the invention is to provide a pneumatic gun for quickly loading and firing conduit cleaning projectiles.

Another object of the invention is to provide a pneumatic gun for quickly loading and firing conduit cleaning projectiles in which foam projectiles are loaded into a gun chamber through a port directly into a positioning nozzle and fired by a compressed air charge.

Another object of the invention is to provide a pneumatic gun for quickly loading and firing conduit cleaning projectiles by means of compressed air with a compressed air relief circuit for dissipating pressurized air in the event of failure of a projectile to pass through a conduit.

Another object of the invention is to provide a pneumatic gun for quickly loading and firing conduit cleaning projectiles by means of compressed air supplied through an air flow control valve which directs air for propelling projectiles and which directs pressurized air to ambiance in the event of failure of a projectile to pass through a conduit.

Other and further objects of the invention will become apparent with an understanding of the following detailed description of the invention or upon employment of the invention in practice.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
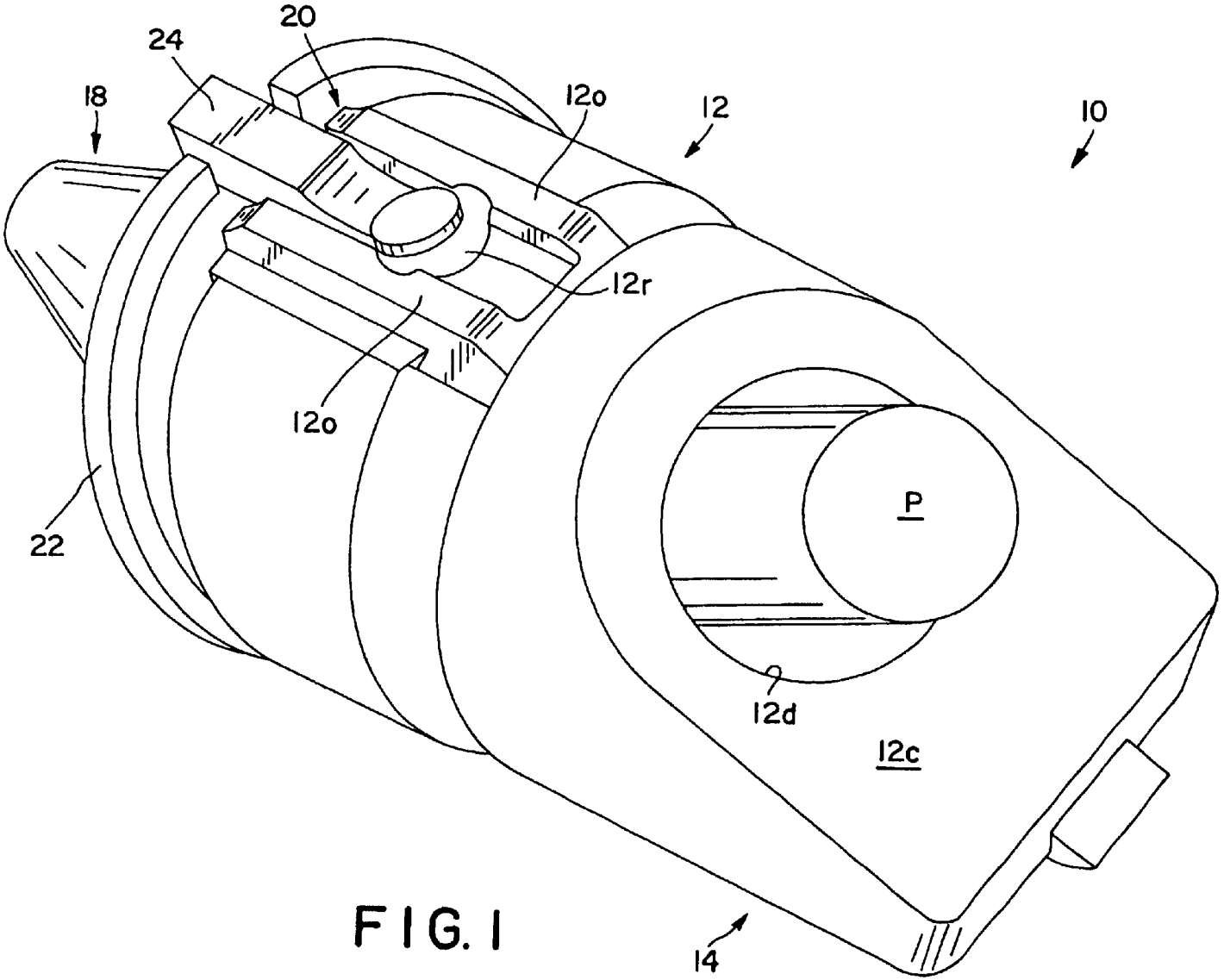
FIG. 1 is a perspective view of a quick load air gun according to the invention showing the loading of a foam projectile through a quick load port.
Figure 2:
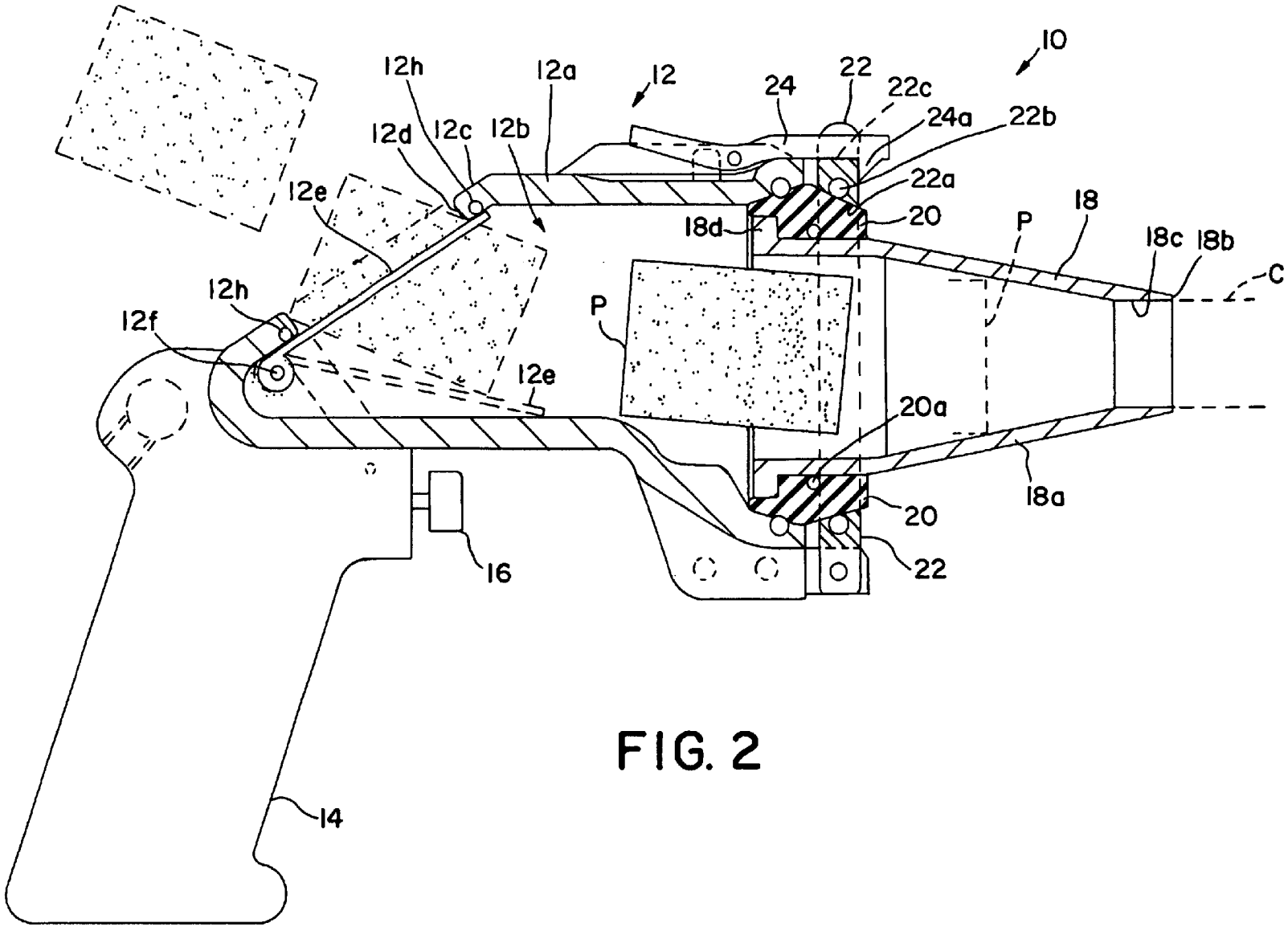
FIG. 2 is a side elevation view partially in section of a preferred embodiment of a quick load air gun according to the invention.
Figure 3:
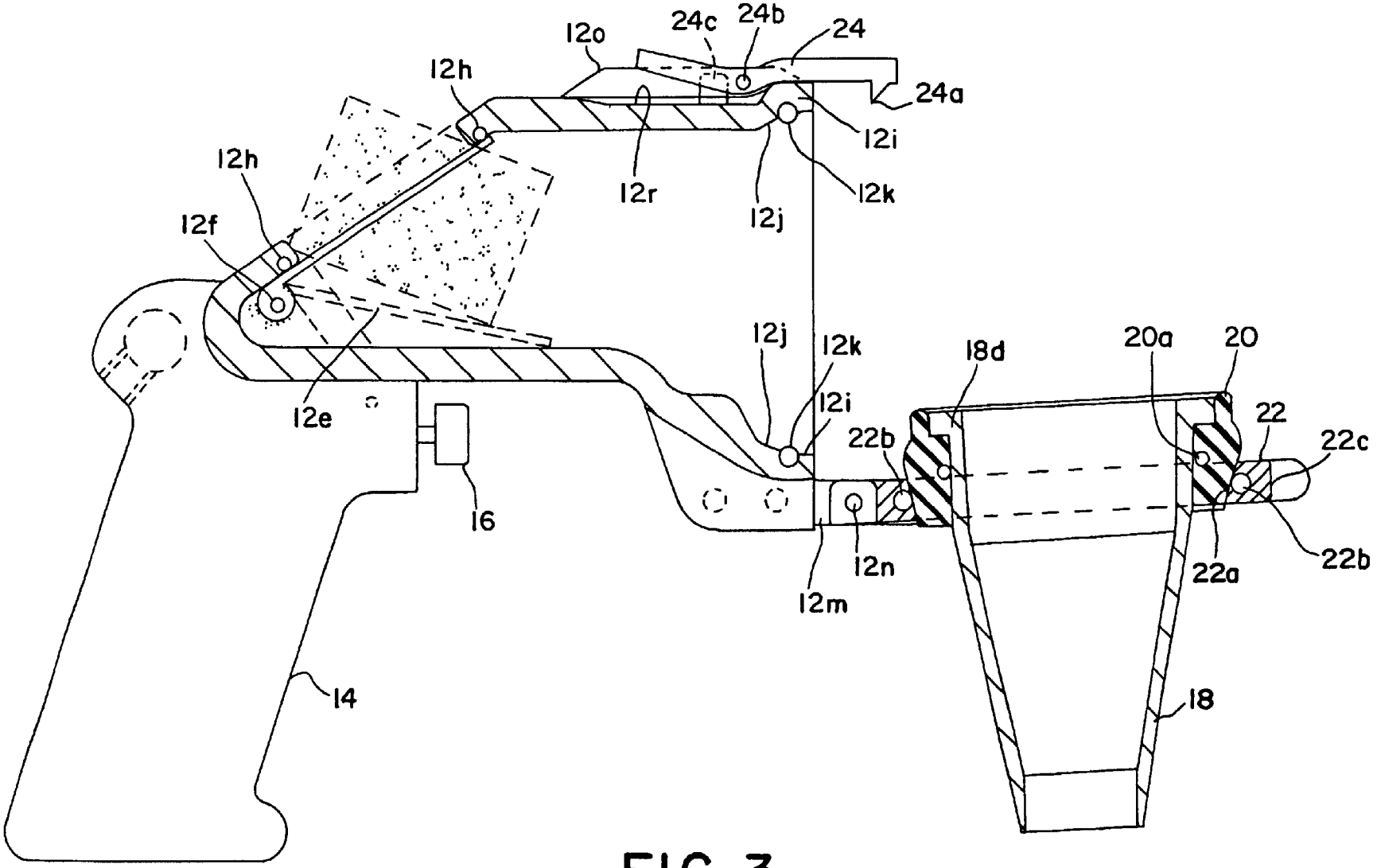
FIG. 3 is a side elevation view of the air gun of FIG. 1 with nozzle ring open for changing a nozzle.

Referring to FIGS. 1–3 of the drawing, a quick load air gun 10 according to the invention comprises a generally cylindrical main housing 12 for receiving foam projectiles P, a handgrip 14 with adjacent trigger 16, and a nozzle 18 with adapter ring 20 subassembly pivotally mounted on the main housing by a latch ring 22.

The main housing 12 is preferably a generally cylindrical shell 12*a* defining a chamber 12*b* for receiving foam projectiles. The main housing is truncated to form a planar rear face 12*c* provided with a circular quick load port 12*d* for inserting projectiles into the housing chamber. A quick load door 12*e* preferably in the form of a disc is pivotally mounted on shaft 12*f* and spring (not shown) loaded within the chamber for normally closing the port. As shown in FIG. 2 the door 12*e* hinges to the dash line position as projectiles are pushed into the chamber, and returns to closed (solid line) position after loading the air gun. The interior chamber wall 12*a* adjacent the perimeter of door is fitted with an O-ring seal 12*h* for air tight contact between the door and the chamber wall particularly when the chamber is pressurized.

The muzzle end of the main housing is circular in configuration defined by an enlarged peripheral flange 12*i* (FIG. 3) having a diverging bevelled annular sealing surface 12*j* preferably fitted with an O-ring seal 12*k*. A hinge plate 12*m* extends from the underside of the muzzle end for pivotally mounting a latch ring 22 at pivot shaft 12*n*. The latch ring 22 includes a converging bevelled annular sealing surface 22*a* preferably fitted with a sealing O-ring 22*b*.

The latch ring 22 includes a notch 22*c* cooperating with a latch bar 24 fitted to the top surface 12*a* of the air gun for holding the latch ring firmly in place at the air gun muzzle. The forward end of the latch bar registers with the notch 22*c* and terminates in a depending hook 24*a* for engaging the forward face of the latch ring holding the ring in closed position.

As shown in FIGS. 1 and 2, the latch bar 24 is positioned atop the main housing between spaced shoulders 12*o* by a pivot shaft 24*b*. A spring 24*c* urges the latch bar into closed position. Preferably the housing surface is recessed 12*r* between the shoulders to accommodate full pivoting movement of the latch bar.

In a preferred embodiment of the invention, the latch ring receives a nozzle 18 and adapter ring 20 subassembly and holds the subassembly in the position of FIG. 2 for directing propelled projectiles into a conduit for cleaning the conduit.

The nozzle 18 is generally conical with body wall 18*a* converging in the direction of projectile travel terminating in a nozzle opening 18*b* with cylindrical inner surface 18*c* that directs projectiles into workpiece conduits C such as pipes, tubes ducts, and so forth. The nozzle base includes an annular flange 18*d* by which the nozzle along with the adapter ring 20 are retained in position on the air gun.

The adapter ring 20 encircles the base of the nozzle with the adapter ring in nested relation to the nozzle flange 18*d* and with an O-ring seal 20*a* at the interface of the nozzle wall and ring. The adapter ring and nozzle subassembly fit into the latch ring with the adapter ring and latch O-ring forming friction fit when the latch ring is latched as in FIG. 2.

As shown in FIG. 3, by releasing the latch bar 24, the latch ring with nozzle/adapter ring subassembly pivots to open position. The latch ring accommodates a range of nozzle sizes corresponding to a range of foam projectile sizes determined by a range of conduit sizes to be cleaned by the air gun and projectiles. It is to be understood that smaller diameter nozzles with adapter rings of constant outer diameter and smaller inner diameter (i.e., thicker cross-section) fit into the latch ring of FIG. 3. In this way, a single air gun with a set of nozzle/adapter ring subassemblies provide for cleaning conduits in a range of sizes.

In another preferred form of the invention, the adapter ring 20 is omitted and the nozzle 18 fits directly into the latch ring 22. In this form of the invention, the surface contour interface of nozzle with sealing O-rings 12*k* and 22*b* is suitably modified to achieve air tight seals without the adapter ring in place.

The air gun as shown in FIG. 2 constitutes an air tight chamber defined by the integral main housing wall, the O-ring sealed port closing member, the nozzle/adapter ring subassembly with O-rings and with a foam projectile advanced to the dash line position in circumferential engagement with the interior nozzle wall. A compressed air charge admitted to the air tight chamber propels the foam projectile through the nozzle into an adjacent conduit.

Figure 4A:
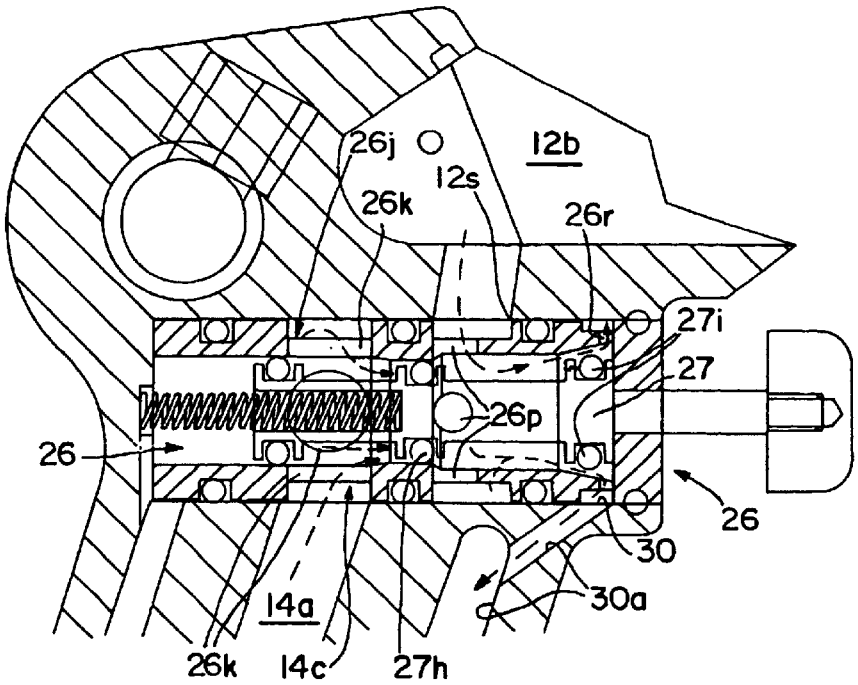
FIGS. 4*a–b* are fragmentary section views of the air gun of FIGS. 1–3 particularly showing air passages in the handgrip prior to propelling a projectile with compressed air and in addition showing air passages in the handgrip for dissipating compressed air from behind a projectile in the event of a blocked conduit.
Figure 4B:
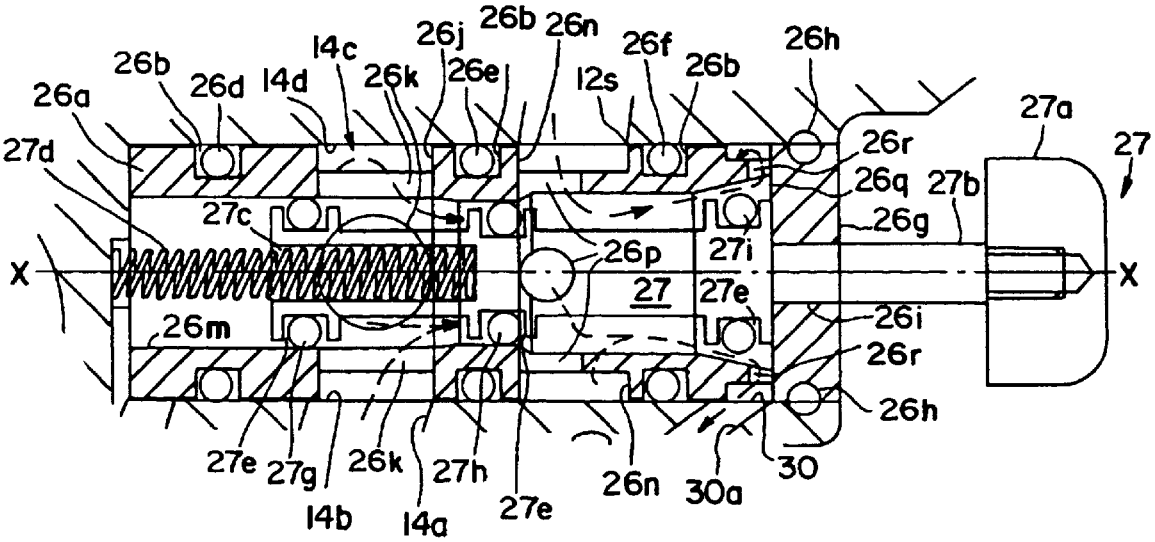
Figure 5A:
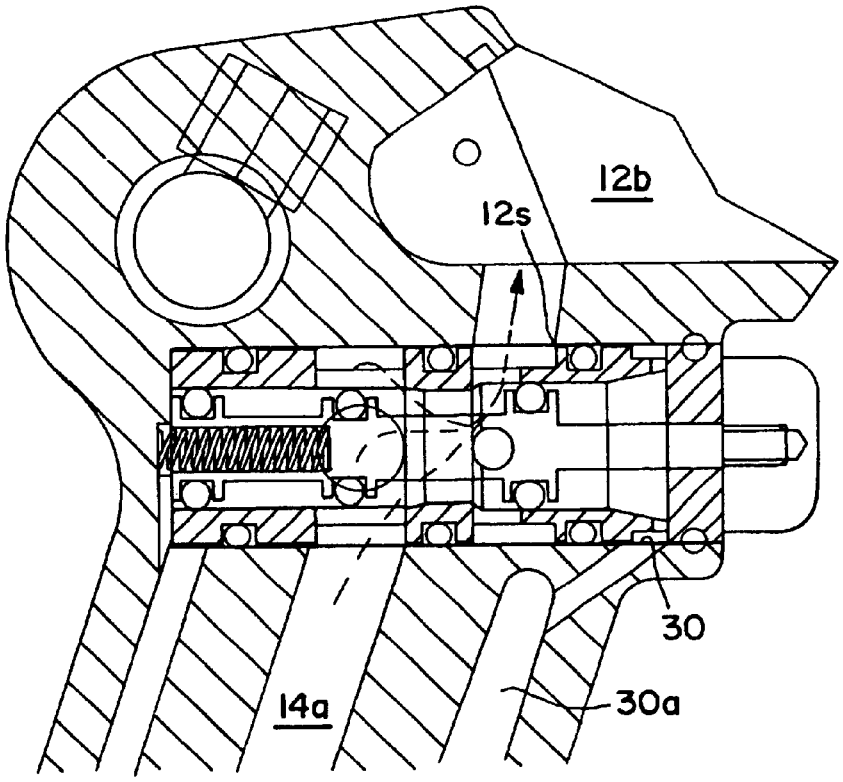
FIGS. 5*a–b* are fragmentary section views of the air gun of FIGS. 1–3 showing position of trigger and air flow control valve for propelling a projectile.
Figure 5B:
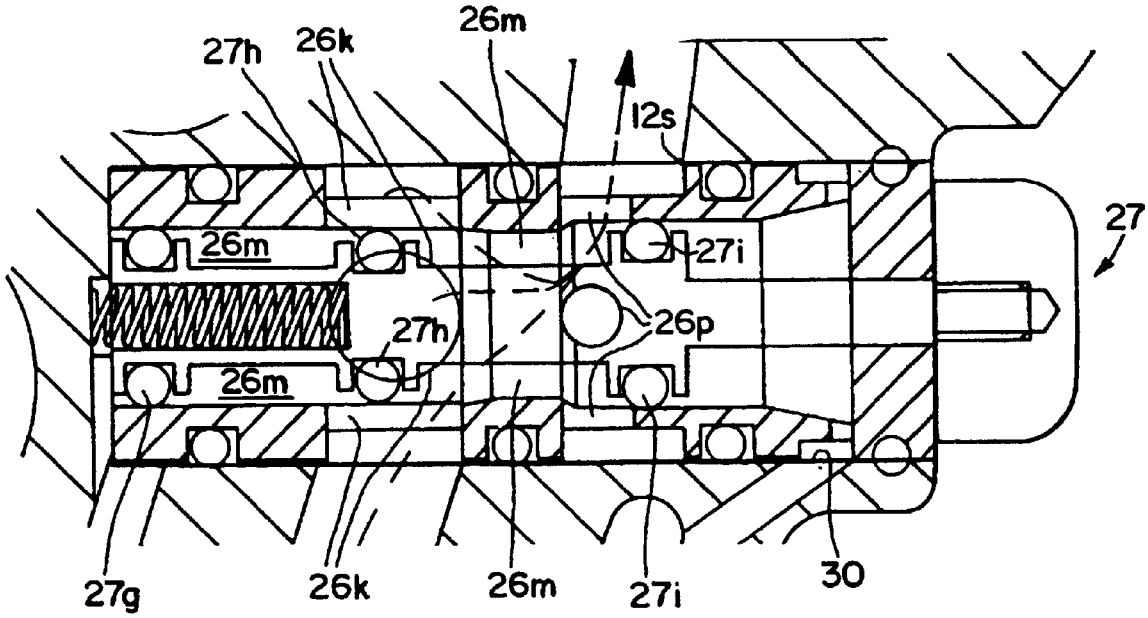

The compressed air circuit for discharging projectiles is shown in FIGS. 4 and 5 within the handgrip 14 of the air gun. A compressed air hose is secured to an air inlet (not shown) at the base of the grip with air passing through supply passage 14*a*, valve port 14*b*, air flow control valve 26, housing port 12*s* and into the main housing chamber 12*b*, and in the event of conduit obstruction, an exhaust port 30 and passages 30*a* to ambiance.

The handgrip 14 includes a valve receiving chamber 14*c* preferably defined by cylindrical wall 14*d* for receiving the air flow control valve 26. The cylindrical wall 14*d* has openings for air flow including valve port 14*b*, housing port 12*s* and exhaust port 30.

The valve 26 comprises a valve body 26*a* generally in the form of a hollow cylinder with three annular grooves 26*b* to accommodate O-ring seals 26*d–f* between valve body and cylindrical wall. A valve head 26*g* is situated at the open end of the valve receiving chamber and is held in place by one or more pins 26*h* inserted between valve head and chamber wall. The valve head retains the valve body within the valve chamber against operating air pressures. The valve head includes a bore 26*i* to accommodate a sliding valve stem 27*b*.

The valve body has a first annular recess 26*j* with several air flow ports 26*k* through the valve body wall all communicating with air supply passage 14*a* so that air flows into the annular recess 26*j* and through the flow ports 26*k* into the hollow interior 26*m* of the valve body.

The valve body has a second annular recess 26*n* with several flow through ports 26*p* all communicating with the housing port 12*s*, the interior 26*m* of the valve body and with exhaust port 30 and exhaust passages 30*a* to ambiance. The leading edge 26*q* of the valve body has several notches 26*r* defining air flow paths from valve interior to exhaust port.

The flow of air from supply passage to air gun chamber to exhaust port, and operation of the air gun, is determined by manipulation a valve slide forming part of the air flow control valve.

As shown in FIGS. 4*a–b*, the valve slide 27 is positioned within the valve body and is actuated by trigger knob 27*a* to control the flow of air from compressed air source, to main housing chamber, and, when required, to ambiance. The valve slide includes a valve stem 27*b* passing through the valve head bore 26*i* with trigger knob 27*a* fitted to one end, and, at the other end, fitted with a spring recess 27*c* receiving a coil spring 27*d*. The valve stem is fitted with three valve seats 27*e* in the form of discs concentric with stem axis x–x' with each disc having an annular groove for receiving O-rings 27*g–i*.

When the air flow control valve is in the position of FIGS. 4*a–b*, compressed air (indicated by dash lines) flows through the valve port 14*b*, into first annular recess 26*j*, and through air flow ports 26*k* to valve interior 26*m* up to sealing O-ring 27*h*.

When the trigger is pulled moving the valve slide to the position of FIG. 5, air flows (dash line) past the O-ring 27*h*, valve interior 26*m*, ports 26*p* and housing port 12*s* into the main housing chamber 12*b* to propel a projectile into a workpiece conduit. As the trigger is pulled, O-ring 27*i* seals the valve interior wall 26*m* from exhaust port 30 thereby directing air through port 12*s* into the main housing chamber 12*b*.

In the event a compressed air charge propels a projectile into a conduit that is blocked preventing passage of the projectile, the air overpressure existing within the air gun chamber represents a potentially hazardous situation for an operator. In such event, the operator by releasing the trigger, allows the air valve to close under the force of coil spring 27*d* to the position of FIGS. 4*a–b*. This action provides an air exhaust channel from chamber 12*b* through port 12*s*, ports 26*p*, and past O-ring 27*i*, through notches 26*r* and into exhaust port 30. The chamber pressure drops to atmospheric and the potentially dangerous condition ends.

The air gun components are of robust construction preferably of cast aluminum or of suitable molded plastic for holding operating air pressures, for durability in a typical industrial environment, and lightweight for ease of handling in completing a conduit cleaning work schedule.

Various changes may be made to the structure embodying the principles of the invention. The foregoing embodiments are set forth in an illustrative and not in a limiting sense. The scope of the invention is defined by the claims appended hereto.

I claim:

1. A quick load air gun for cleaning conduits and the like comprising a main housing defining a chamber for receiving conduit cleaning projectiles and defining a muzzle, a hand grip with trigger attached to the main housing, a latch ring pivotally mounted on the main housing, a nozzle fitted to the latch ring for closing the muzzle of the air gun, the main housing having a port for inserting projectiles into the chamber, a port closing member for normally closing the port, and means for admitting a charge of compressed air into the chamber for propelling projectiles from the gun through the nozzle.

2. A quick load air gun for cleaning conduits and the like comprising a main housing defining a chamber for receiving conduit cleaning projectiles and further defining a muzzle, a hand grip with trigger integral to the main housing, a latch ring pivotally mounted on the main housing, a nozzle fitted to the latch ring for closing the muzzle of the air gun, means for securing the latch ring and nozzle in air tight relationship with the muzzle of the gun, the main housing having a port for inserting projectiles into the chamber, a port closing member for normally closing the port, means for admitting a charge of compressed air into the chamber for propelling projectiles from the gun through the nozzle by actuating the trigger, and means for venting the chamber to ambiance by release of the trigger.

3. A quick load air gun for cleaning conduits and the like comprising a main housing defining a chamber with a port for receiving conduit cleaning projectiles, the chamber having an open muzzle, a latch ring mounted on the main housing, a nozzle/adapter ring subassembly fitted to the latch ring for closing the muzzle, means for securing the latch ring in closed position at the muzzle, a port closing member for normally closing the port, and means for admitting a charge of compressed air into the chamber for propelling projectiles from the gun through the nozzle into a conduit.

4. A quick load air gun for cleaning conduits and the like comprising a main housing defining a chamber with a port for receiving conduit cleaning projectiles, the chamber having an open muzzle, a latch ring mounted on the main housing, a nozzle/adapter ring subassembly fitted to the latch ring for closing the muzzle, means for securing the latch ring in closed position at the muzzle, a port closing member for normally closing the port, means for admitting a charge of compressed air into the chamber for propelling projectiles from the gun through the nozzle into a conduit, and means for exhausting the air chamber to ambiance.

5. The quick load air gun as defined in claim 4 in which the main housing is generally cylindrical with truncated rear face, the port formed in the rear face, and the port closing member being pivotally fitted to the main housing and spring biased for normally closing the port.

6. The quick load air gun as defined in claim 5 which further includes means for an air tight seal around the port between the rear face and the port closing member.

7. A quick load air gun for cleaning conduits by propelling foam projectiles through the conduits, the air gun comprising a main housing defining a chamber for receiving projectiles, the main housing having a muzzle, a hand grip with trigger attached to the main housing, a latch ring mounted on the main housing, a nozzle fitted to the latch ring for closing the muzzle, the main housing having a port for inserting projectiles into the chamber, a port closing member for normally closing the port, air passage means through the grip, a trigger actuated valve in the air passage for selectively admitting a charge of compressed air into the chamber for propelling projectiles from the gun through the nozzle.

8. A quick load air gun for cleaning conduits by propelling foam projectiles through the conduits, the air gun comprising a main housing defining a chamber for receiving projectiles, the main housing having a muzzle, a hand grip with trigger attached to the main housing, a latch ring mounted on the main housing, a nozzle fitted to the latch ring for closing the muzzle, the main housing having a port for inserting projectiles into the chamber, a port closing member for normally closing the port, air passage means through the grip for supplying compressed air to the chamber, a trigger actuated valve in the air passage for selectively admitting a charge of compressed air into the chamber for propelling projectiles from the gun through the nozzle, a vent passage for exhausting the chamber to ambiance, said trigger actuated valve further having means for venting the chamber to ambiance.

9. The quick load air gun as defined in claim 8 in which the trigger actuated valve admits a charge of compressed air into the chamber when the trigger is pulled, and vents the chamber to ambiance when the trigger is released.

10. A quick load air gun for cleaning conduits and the like comprising a main housing defining a chamber for receiving conduit cleaning projectiles and defining a muzzle, a hand grip attached to the main housing, a nozzle for closing the muzzle of the air gun, the main housing having a port for inserting projectiles into the chamber, a port closing member for normally closing the port, an air passage for supplying compressed air to the chamber, an air flow control valve for directing compressed air into the chamber for propelling projectiles from the gun through the nozzle, and said valve having means for venting the chamber to ambiance.

11. A quick load air gun for cleaning conduits and the like comprising a main housing defining a chamber for receiving conduit cleaning projectiles and defining a muzzle, a hand grip with trigger attached to the main housing, a nozzle for closing the muzzle of the air gun, the main housing having a port for inserting projectiles into the chamber, a port closing member for normally closing the port, a first air passage for supplying compressed air to the chamber, a second air passage for venting the chamber, an air flow control valve actuated by the trigger for directing compressed air into the chamber through the first air passage for propelling projectiles from the gun through the nozzle, and said valve for venting the chamber to ambiance through the second air passage upon release of the trigger.

12. A quick load air gun for cleaning conduits and the like comprising a main housing defining a chamber for receiving conduit cleaning projectiles and defining a muzzle, a hand grip with trigger attached to the main housing, a nozzle for closing the muzzle of the air gun, the main housing having a port for inserting projectiles into the chamber, a port closing member for normally closing the port, a first air passage for supplying compressed air to the chamber, a second air passage for venting the chamber, an air flow control valve actuated by the trigger for controlling air flow in said first and second passages, said valve having a first normal position with trigger released in which the chamber is vented through the second air passage, the vent having a second position in which compressed air is admitted to the chamber through the first passage so that if a conduit is blocked air pressure in the chamber is vented by release of the trigger.

* * * * *